US010249981B2

(12) United States Patent
Chen

(10) Patent No.: US 10,249,981 B2
(45) Date of Patent: Apr. 2, 2019

(54) HIGH-SPEED SIGNAL TRANSMISSION CONNECTOR WITH HIGH WATER RESISTANCE

(71) Applicant: AIMMET INDUSTRIAL CO., LTD., Tainan (TW)

(72) Inventor: Hsiang Feng Chen, Tainan (TW)

(73) Assignee: AIMMET INDUSTRIAL CO., LTD., Tainan (TW)

( * ) Notice: Subject to any disclaimer, the term of this patent is extended or adjusted under 35 U.S.C. 154(b) by 0 days.

(21) Appl. No.: 15/874,823

(22) Filed: Jan. 18, 2018

(65) Prior Publication Data

US 2019/0052012 A1 Feb. 14, 2019

(30) Foreign Application Priority Data

Aug. 8, 2017 (TW) ..... 106126801 A

(51) Int. Cl.
*H01R 13/52* (2006.01)
*H01R 24/52* (2011.01)
*H01R 103/00* (2006.01)

(52) U.S. Cl.
CPC ..... *H01R 13/5219* (2013.01); *H01R 13/521* (2013.01); *H01R 13/5202* (2013.01); *H01R 24/52* (2013.01); *H01R 2103/00* (2013.01)

(58) Field of Classification Search
CPC ..... H01R 13/5219; H01R 13/521; H01R 13/523; H01R 13/5202; H01R 13/533
USPC ..... 439/271, 274, 275, 279, 278, 89, 230, 439/548, 556, 559, 587
See application file for complete search history.

(56) References Cited

U.S. PATENT DOCUMENTS 6,280,208 B1 * 8/2001 Masuda ..... H01R 4/64 174/359
6,824,403 B2 * 11/2004 Hall ..... H01R 24/50 439/101
7,052,319 B1 * 5/2006 Chen ..... H01R 13/41 439/595
7,153,161 B2 * 12/2006 Huang ..... H01R 9/0524 439/583
7,494,374 B2 * 2/2009 Hall ..... H01R 13/748 439/564
7,871,295 B2 * 1/2011 Zhang ..... H01R 13/42 439/578
8,147,272 B2 * 4/2012 Rhein ..... H01R 13/5202 439/556
8,585,415 B2 * 11/2013 Marsh ..... H01R 9/0527 439/98

* cited by examiner

*Primary Examiner* — Harshad C Patel
(74) *Attorney, Agent, or Firm* — J.C. Patents

(57) ABSTRACT

This invention relates to a high-speed signal transmission connector with high water resistance, which includes at least a casing and a terminal block. A first seal ring is provided on said casing, a second seal ring is set between said casing and said terminal block and a third seal ring is mounted inside said terminal block. So that the second seal ring and the third seal ring of the present invention enable the connector to have an internal waterproof function, and the first seal ring also enable the connector to have a waterproof connection function. With this triple-waterproof technology, the present invention ensures that the external moisture will not infiltrate into the connector and enhances the water resistance and safety of the high-speed signal transmission connector.

11 Claims, 3 Drawing Sheets

HIGH-SPEED SIGNAL TRANSMISSION CONNECTOR WITH HIGH WATER RESISTANCE

CROSS-REFERENCE TO RELATION APPLICATION

This application claims the priority benefit of Taiwan application No. 106126801, filed on Aug. 8, 2017, which is hereby incorporated by reference in its entirety and made a part of this specification.

BACKGROUND OF THE INVENTION

1. Field of the Invention

This invention relates to a high-speed signal transmission connector with high water resistance, particularly to a high-speed signal transmission connector with body internal waterproof function and waterproof connection function.

2. Description of the Prior Art

For general vehicle, the electronic devices are provided inside the vehicle and to use a high-speed signal transmission connector to connect the signal of the electronic devices, so that the foregoing vehicle connectors are not waterproof, only for anhydrous environment.

However, with the advancement of science and technology, the demand for vehicle external electronic devices (such as 360-degree panoramic camera, camera, reversing photography, range finder and so on) is increasing, the external electronic devices will contact with external moisture (for example, rain, car wash or dew) and the external moisture easily infiltrates into the seams of external electronic devices and flows along the signal lines into the interior of the vehicle. Because of the foregoing signal transmission connectors have no waterproof function, if the moisture flows to the connector, the moisture will infiltrate into the place which the connector connected with the signal lines or infiltrate into the connector directly, resulting in damage to the vehicle electronic system, thereby affecting the traffic safety and the service life of the electronic device.

For this reason, the inventor of this invention, having much experience in designing and manufacturing connectors and its related products, understands and researches the problem of the foregoing connectors without waterproof function and hence devised this invention.

SUMMARY OF THE INVENTION

The objective of this invention is to offer a high-speed signal transmission connector with high water resistance, which is used a triple-waterproof technology to ensure that the external moisture will not infiltrate into the connector and also enhance the water resistance and safety of the high-speed signal transmission connector.

The high-speed signal transmission connector with high water resistance in the present invention includes at least a casing 1 and a terminal block 2. The casing has a first through-hole for placing the terminal block therein; a first inner circumference is provided on the inner rear end of the casing and a first step-like groove is formed on the rear end of the first inner circumference for placing a second seal ring therein; a flange is provided at the rear end of the terminal block, the front surface of the flange has a second annular recess, the second seal ring is sandwiched between the first step-like groove of the first inner circumference of the casing and the second annular recess of the flange of the terminal block; the terminal block has a second through-hole with a first insulation member and a second insulation member being provided therein, terminals are mounted inside the first insulation member and the second insulation member to insulate the terminals from the terminal block; a second inner circumference is provided on the inner rear end of the terminal block and a second step-like groove is formed on the front end of the second inner circumference for placing a third seal ring therein, the third seal ring is sandwiched between the terminals, the second step-like groove, the first insulation member and the second insulation member.

The high-speed signal transmission connector with high water resistance of present invention, among which a first outer circumference may be provided on the outer rear end of the casing and the front end of the first outer circumference has a first annular recess for placing a first seal ring therein.

The high-speed signal transmission connector with high water resistance of present invention, among which a positioning block may be provided between the casing and the terminal block to firmly fix the terminal block in the casing and make sure that the connector can be precisely connected with the signal cable.

BRIEF DESCRIPTION OF DRAWINGS

This invention will be better understood by referring to the accompanying drawings, wherein.

DETAILED DESCRIPTION OF THE PREFERRED EMBODIMENT

A preferred embodiment of the high-speed signal transmission connector with high water resistance in the present invention, as shown in FIGS. 1 to 5, includes at least a casing 1 and a terminal block 2 as main components combined together.

Figure 4:
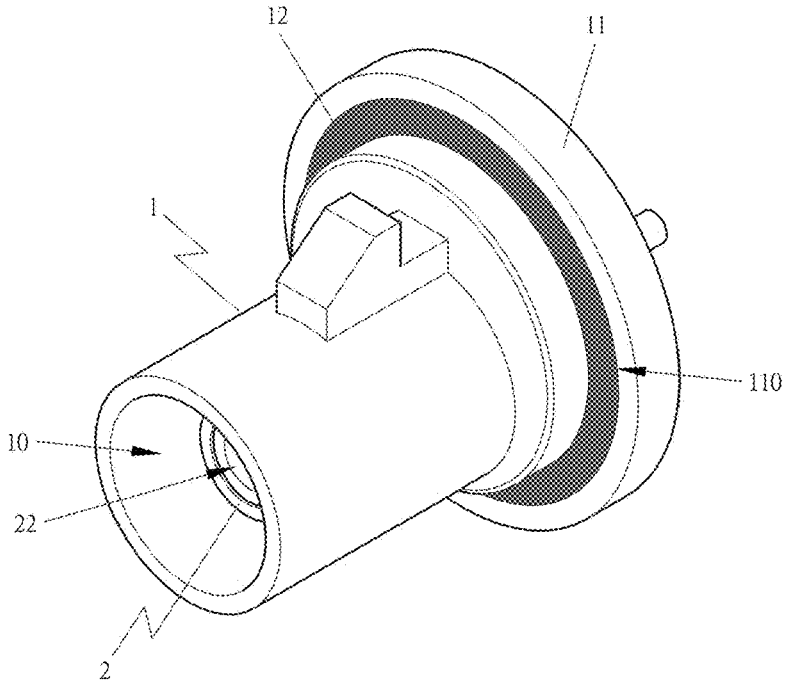
FIG. 4 is a three-dimensional view in the present invention.

The casing 1 has a first through-hole 10 for placing the terminal block 2 therein, a first outer circumference 11 is provided on the outer rear end of the casing 1 and the front end of the first outer circumference 11 has a first annular recess 110 for placing a first seal ring 12 therein (as shown in FIG. 4). So that, the first seal ring 12 can block the external moisture infiltrates into the connector from the first outer circumference 11 of the casing 1, when the connector is connected to the signal cable. A first inner circumference 13 is provided on the inner rear end of the casing 1 and a first step-like groove 130 is formed on the rear end of the first inner circumference 13 for placing a second seal ring 12 therein.

Figure 1:
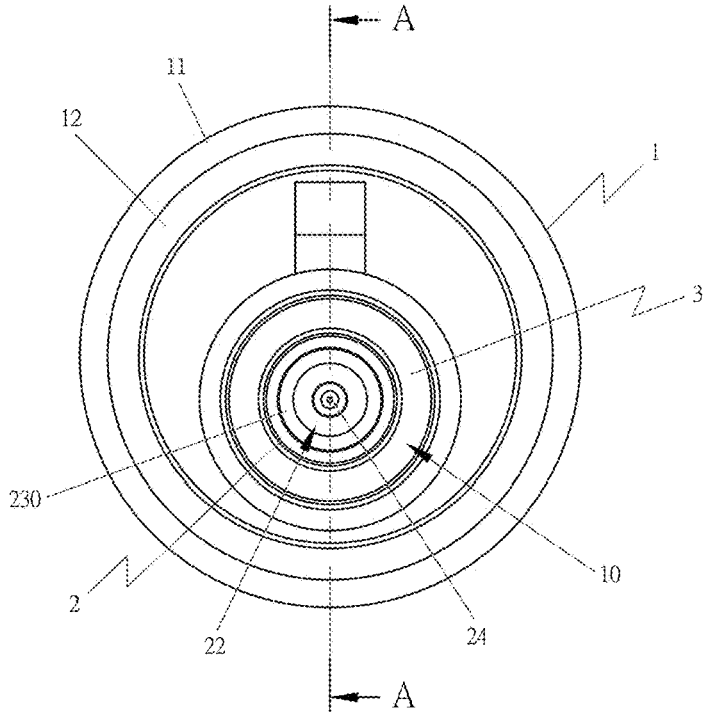
FIG. 1 is a fore side view in the present invention.
Figure 2:
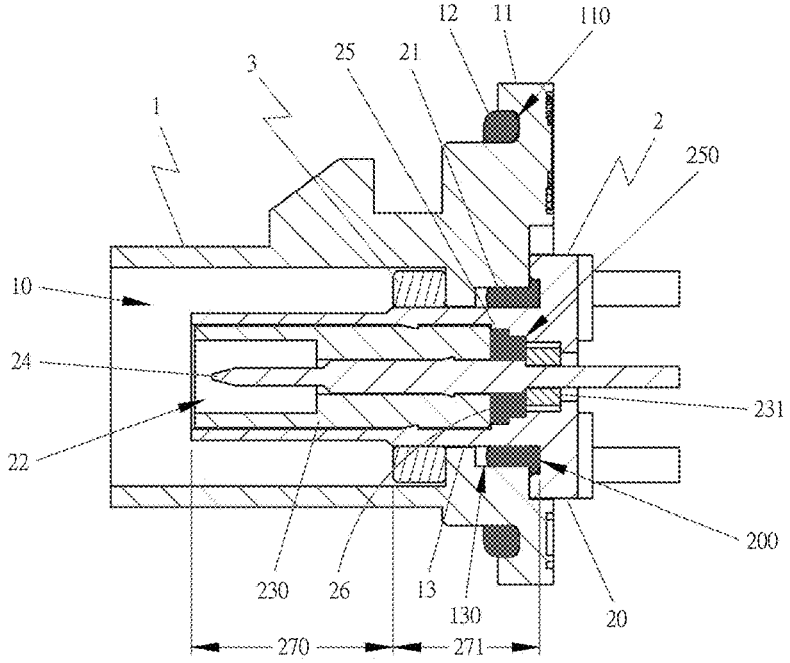
FIG. 2 is an sectional view of A-A shown in FIG. 1.
Figure 3:
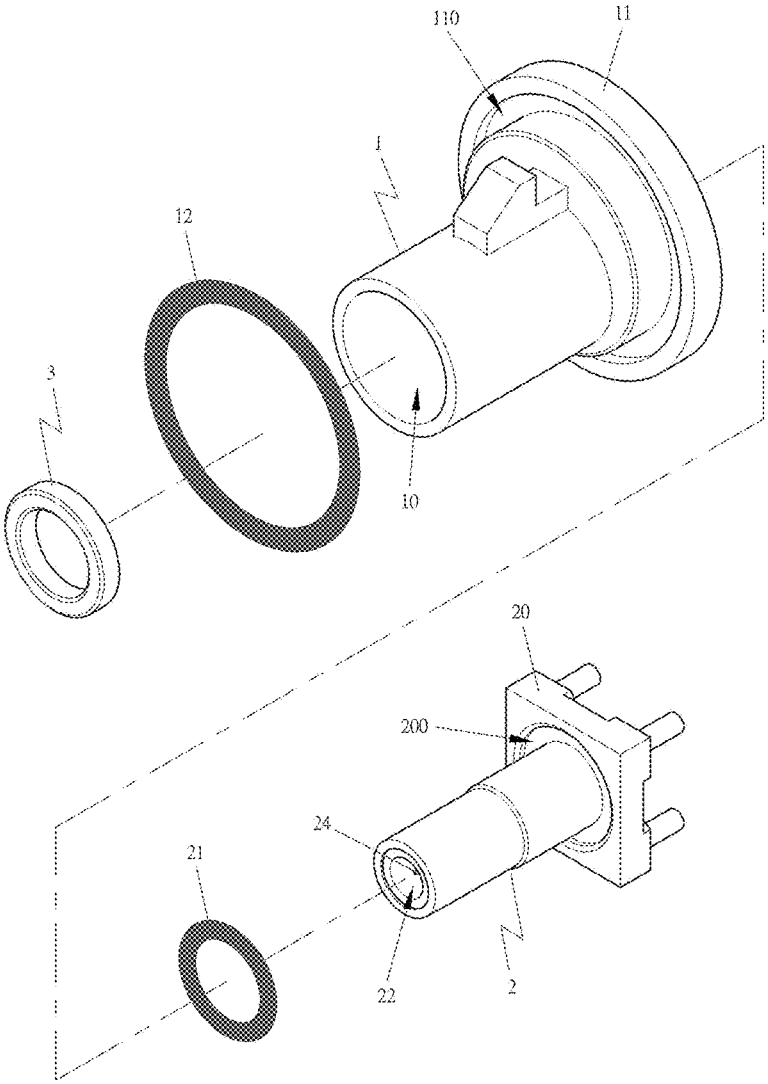
FIG. 3 is an installation operation view in the present invention.
Figure 5:
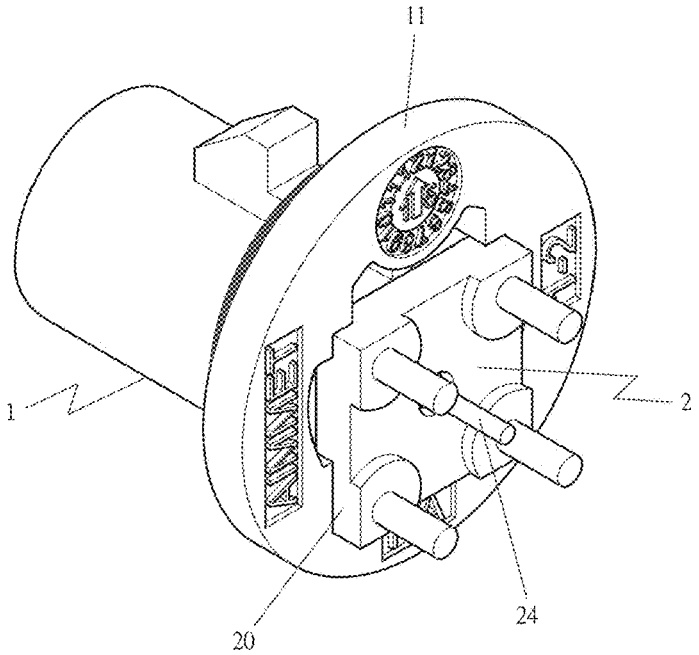
FIG. 5 is an another three-dimensional view in the present invention.

A flange 20 is provided at en the outer rear end of the terminal block 2, the shape of the second outer circumference 20 is corresponded to the shape of the first inner circumference 13 of the casing 1 to position the connection direction of the terminal block 2 and the housing casing 1 (as shown in FIG. 5). The front end of the flange 20 has a second annular recess 200, the second seal ring 12 is sandwiched between the first step-like groove 130 of the first inner circumference 13 of the casing 1 and the second annular recess 200 of the flange 20 of the terminal block 2 to block the external moisture infiltrates into the connector from the connection location of the casing 1 and the terminal block 2 (as shown in FIG. 2).

The terminal block 2 has a second through-hole 22 with a first insulation member 230 and a second insulation member 231 being provided therein, the terminals 24 are mounted inside the first insulation member 230 and the second insulation member 231 to insulate the terminals 24 from the terminal block 2. A second inner circumference 25 is provided on the inner rear end of the terminal block 2 and a second step-like groove 250 is formed on the front end of the second inner circumference 25 for placing a third seal ring 26 therein, the third seal ring 26 is sandwiched between the terminals 24, the second step-like groove 250, the first insulation member 230 and the second insulation member 231 to block the external moisture infiltrates into the connector from the connection location of the terminal block 2 and the terminals 24 (as shown in FIG. 2).

A positioning block 3 may be provided between the casing 1 and the terminal block 2 to firmly fix the terminal block 2 in the casing 1 and make sure that the connector can be precisely connected with the signal cable, said positioning block 3 may be made of metal. The terminal block 2 has a front end portion 270 and a rear end portion 271, the outer diameter of the front end portion 270 is smaller than the outer diameter of the rear end portion 271, so that the positioning block 3 can be rapidly inserted into the space between the casing 1 and the terminal block 2 from the front end portion 270 of the terminal block 2, and the rear end portion 271 of the terminal block 2 can be used to tightly fix the positioning block 3 between the casing 1 and the terminal block 2.

Therefore, the second seal ring 21 and the third seal ring 26 of the present invention enable the connector to have an internal waterproof function, and the first seal ring 12 also enable the connector to have a waterproof connection function. With this triple-waterproof technology, the present invention ensures that the external moisture will not infiltrate into the connector and enhances the water resistance and safety of the high-speed signal transmission connector. Evidently this invention has tangible benefits and tallies with progressiveness and novelty demanded by patent laws.

While the preferred embodiments of this invention have been described above, it will be recognized and understood that various modifications may be made therein and appended claims are intended to cover all such modifications that may fall within the spirit and scope of the invention.

What is claimed is:

1. A high-speed signal transmission connector with high water resistance at least comprising:

a casing and a terminal block, wherein said casing has a first through-hole for placing said terminal block therein; a first inner circumference is provided on an inner rear end of the casing and a first step-like groove is formed on a rear end of the first inner circumference for placing a second seal ring therein;

a flange is provided at an rear end of the terminal block, a front surface of the flange has a second annular recess, the second seal ring is sandwiched between the first step-like groove of the first inner circumference of the casing and the second annular recess of the flange of the terminal block to block external moisture from infiltrating into the connector from a connection location of the casing and the terminal block;

the terminal block has a second through-hole with a first insulation member and a second insulation member being provided therein, a terminal is mounted inside the first insulation member and the second insulation member to insulate the terminal from the terminal block; a second inner circumference is provided on the inner rear end of the terminal block and a second step-like groove is formed on a front end of the second inner circumference for placing a third seal ring therein, the third seal ring is sandwiched between the terminal, the second step-like groove, the first insulation member and the second insulation member to block external moisture from infiltrating into the connector from a connection location of the terminal block and the terminal.

2. The high-speed signal transmission connector with high water resistance according to claim 1, wherein a shape of the flange corresponds to a shape of said first inner circumference to position a connection direction of the terminal block and the casing.

3. The high-speed signal transmission connector with high water resistance according to claim 1, wherein a positioning block is provided between the casing and the terminal block to firmly fix the terminal block in the casing and make sure that the connector can be precisely connected with a signal cable.

4. The high-speed signal transmission connector with high water resistance according to claim 3, wherein said positioning block is made of metal.

5. The high-speed signal transmission connector with high water resistance according to claim 3, wherein the terminal block has a front end portion and a rear end portion, an outer diameter of the front end portion is smaller than an outer diameter of the rear end portion, so that the positioning block can be rapidly inserted into a space between the casing and the terminal block from the front end portion of the terminal block, and the rear end portion of the terminal block can be used to tightly fix the positioning block between the casing and the terminal block.

6. The high-speed signal transmission connector with high water resistance according to claim 1, wherein a first outer circumference is provided on an outer rear end of the casing and a front end of the first outer circumference has a first annular recess for placing a first seal ring therein.

7. The high-speed signal transmission connector with high water resistance according to claim 6, wherein a shape of the flange corresponds to a shape of said first inner circumference to position a connection direction of the terminal block and the casing.

8. The high-speed signal transmission connector with high water resistance according to claim 6, wherein a positioning block is provided between the casing and the terminal block to firmly fix the terminal block in the casing and make sure that the connector can be precisely connected with a signal cable.

9. The high-speed signal transmission connector with high water resistance according to claim 8, wherein said positioning block is made of metal.

10. The high-speed signal transmission connector with high water resistance according to claim 8, wherein the terminal block has a front end portion and a rear end portion, an outer diameter of the front end portion is smaller than an outer diameter of the rear end portion, so that the positioning block can be rapidly inserted into a space between the casing and the terminal block from the front end portion of the terminal block, and the rear end portion of the terminal block can be used to tightly fix the positioning block between the casing and the terminal block.

11. The high-speed signal transmission connector with high water resistance according to claim 1, wherein the flange is of a rectangular shape.

* * * * *